US006647933B2

(12) United States Patent
Tsukada et al.

(10) Patent No.: US 6,647,933 B2
(45) Date of Patent: Nov. 18, 2003

(54) ELECTRONIC CONTROL UNIT FOR TWO-CYCLE INTERNAL COMBUSTION ENGINE

(75) Inventors: Yoshikazu Tsukada, Numazu (JP); Yoshinobu Arakawa, Numazu (JP); Kouji Sasaki, Numazu (JP); Mitsugu Koike, Numazu (JP)

(73) Assignee: Kokusan Denki Co., Ltd., Numazu (JP)

( * ) Notice: Subject to any disclaimer, the term of this patent is extended or adjusted under 35 U.S.C. 154(b) by 0 days.

(21) Appl. No.: 10/331,401

(22) Filed: Dec. 30, 2002

(65) Prior Publication Data

US 2003/0177990 A1 Sep. 25, 2003

(30) Foreign Application Priority Data

Mar. 20, 2002 (JP) ..... 2002-078677

(51) Int. Cl.[7] ..... F01L 13/02

(52) U.S. Cl. ..... 123/41 E; 123/41 R; 123/65 PE; 123/65 A; 123/65 P

(58) Field of Search ..... 123/90.15, 41 R, 123/41 E, 52.5, 65 PE, 65 A, 65 P, 90.11, 90.16, 90.23, 90.3, 90.32

(56) References Cited

U.S. PATENT DOCUMENTS 5,036,802 A 8/1991 D'Amours ..... 123/41 E
5,469,818 A 11/1995 Yoshioka et al. ..... 123/90.15
6,044,807 A * 4/2000 Hata ..... 123/41 E
6,357,398 B1 * 3/2002 Arakawa et al. ..... 123/41 E
6,405,687 B1 * 6/2002 Arakawa et al. ..... 123/41 E
6,474,273 B1 * 11/2002 Kinoshita et al. ..... 123/41 E

* cited by examiner

*Primary Examiner*—Thomas Denion
*Assistant Examiner*—Kyle Riddle
(74) *Attorney, Agent, or Firm*—Pearne & Gordon LLP

(57) ABSTRACT

An electronic control unit for a two-cycle internal combustion engine including an exhaust control valve which adjusts exhaust timing, a valve controller which controls the exhaust control valve, and a reversal controller which controls reversing a rotational direction of the engine in accordance with an instruction for reversal. In order to raise the probability of a success in reversing the rotational direction of the engine by generating a stable combustion pressure during the reversal of the rotational direction, there is provided valve opening and closing operation inhibition means which inhibits an opening and closing operation of the exhaust control valve by fixing the exhaust control valve in a fully-closed position while the reversal controller is performing control to reverse the rotational direction of the engine.

6 Claims, 5 Drawing Sheets

ELECTRONIC CONTROL UNIT FOR TWO-CYCLE INTERNAL COMBUSTION ENGINE

TECHNICAL FIELD OF THE INVENTION

The present invention relates to an electronic control unit for a two-cycle internal combustion engine which performs control of an exhaust control valve provided in such a manner as to open and close an upper part of an exhaust port in order to adjust exhaust timing and control for reversing a rotational direction of the engine in accordance with an instruction for reversal.

BACKGROUND OF THE INVENTION

In a two-cycle internal combustion engine, it is possible to increase an output of the engine by increasing an intake air amount by using a pulsation of exhaust thereby to increase a charging efficiency. For this reason, in a two-cycle internal combustion engine for which an increase in the output is necessary, by providing an exhaust control valve which opens and closes an upper part of an exhaust port and exhaust control valve control means which controls the exhaust control valve in response to a rotational speed of the engine, a position of the exhaust control valve is controlled between a fully-closed position and a fully-opened position in order to obtain an exhaust pulsation effect from a low-speed region to a high-speed region of the engine.

Incidentally, as a matter of fact, the fully-closed position of the exhaust control valve is a position where exhaust timing is delayed most (a position where the upper part of the exhaust port is completely closed) and is not a position where the whole exhaust port is closed.

As described in the U.S. Pat. No. 5,469,818, for example, there is known a controller of an exhaust control valve, which comprises a motor-driven actuator which operates an exhaust control valve and a valve position sensor which detects a position of the exhaust control valve. In this controller, the actuator is controlled in order to coincide a valve position detected by the valve position sensor with a desired position.

In general, when the upper part of the exhaust port is opened (when the exhaust timing is advanced) by increasing an opening degree of the exhaust control valve, a great exhaust pulsation effect is obtained in the high-speed rotation range and the charging efficiency can be increased, whereby the output of the engine can be increased.

Furthermore, when the upper part of the exhaust port is closed (when exhaust timing is delayed) by displacing the exhaust control valve to the fully-closed position, the great exhaust pulsation effect is obtained in the low-speed rotation range and the charging efficiency can be increased, whereby the output of the engine can be increased in the low-speed range.

In the internal combustion engine provided with the exhaust control valve of this kind, when a condition that the exhaust control valve is kept in the closed position or the opened position continues for a long time, foreign substances, such as carbon contained in the exhaust of the engine and tar formed by mixing unburned gas contained in the exhaust gas with oil, adhere to the valve and it becomes difficult for the valve to move, thus making it difficult to control the valve.

Therefore, in an internal combustion engine provided with an exhaust control valve, foreign substances such as carbon and tar are removed by performing a cleaning operation which involves forcedly moving the exhaust control valve from the fully-closed position to the fully-opened position and the cleaning operation which involves forcedly moving the exhaust control valve from the fully-opened position to the fully-closed position.

In vehicles which put importance on simplicity of the operation, such as a motor scooter and a snowmobile, usually a transmission cannot be provided with gears for backing up and, therefore, it was impossible to perform a backward travel operation with power of an internal combustion engine. Recently, however, with a feature of a two-cycle internal combustion engine which can rotate in both forward and reverse directions, trials have been made to cause not only forward travel, but also backward travel to be performed by use of the engine by performing a reversal control which allows the rotational direction of the internal combustion engine to reverse in accordance with an instruction for reversion.

The reversal control for reversing the rotational direction of an engine can be performed as follows as described in the U.S. Pat. No. 5,036,802, for example.

That is, when an driver performs an operation for giving an instruction for reversal, such as an operation of a reversal switch, after lowering of an inertia force of a piston of the engine by lowering the rotational speed of the engine to a sufficiently low speed which is not more than an idling speed by a misfire of the engine, a cut of fuel, a delay of ignition timing, etc., an explosive force overcoming the inertial force of the piston which has displaced toward a top dead center is generated by igniting the engine at excessively advanced timing and a rotational direction of a crankshaft is reversed by pushing back the piston. Then, after it is ascertained that the rotational direction of the engine is reversed, the engine is ignited at a timing suitable for keeping the operation of the engine in the reversed rotational direction, thereby the operation of the engine is continued in the reversed rotational direction.

In order to certainly perform the reversal control each time in a two-cycle internal combustion engine which is so designed as to perform such reversal control as described above, it is necessary to generate an appropriate combustion pressure in a stable manner when the ignition timing is excessively advanced.

However, in a two-cycle internal combustion engine provided with the exhaust control valve, a compressibility of an air-fuel mixture changes depending on the position of the exhaust control valve. When the compressibility changes, an air-fuel ratio which is most suited for combustion changes. Therefore, the combustion pressure tends to fluctuate according to the change in the position of the exhaust control valve.

In particular, during a cleaning operation, a fluctuation width of combustion pressure increases during a period in which the exhaust control valve is displaced from the fully-closed position to the fully-opened position and during a period in which the exhaust control valve is displaced from the fully-opened position to the fully-closed position.

For this reason, if the cleaning operation of the exhaust control valve happens to take place when the reversal control is being performed, the combustion pressure produced within the cylinder during an ignition operation performed at excessively advanced timing is not stable, thus causing a problem that probability of a failure in reversing the rotational direction increases due to an insufficient combustion pressure.

In particular, in a two-cycle internal combustion engine for which a fuel is supplied by an electronic fuel injection device, it is difficult to finely control an injection amount of the fuel so that an air-fuel ratio of an air-fuel mixture is adapted to a change in the compressibility of air-fuel mixture while the compressibility is changing due to a change in a position of an exhaust control valve. Therefore, the injection amount of the fuel tends to become indefinite while the position of the exhaust control valve is changing during the reversal control. For this reason, the combustion which takes place during an ignition operation performed at excessively advanced timing becomes unstable when the position of the exhaust control valve is changing during the reversal control, and the combustion pressure may sometimes become insufficient. A probability of a failure in reversal control increases due to this insufficient combustion pressure.

SUMMARY OF THE INVENTION

Accordingly, an object of the present invention is to lower a probability of failure in control to reverse a rotational direction of a two-cycle internal combustion engine provided with a valve controller which controls a position of an exhaust control valve and a reversal controller which performs control to reverse the rotational direction of the engine.

The above-described object is achieved by providing an electronic control unit for a two-cycle internal combustion engine which comprises: a valve controller, which controls a position of an exhaust control valve provided in such a manner as to open and close an upper part of an exhaust port of the internal combustion engine to adjust an exhaust timing of the two-cycle internal combustion engine; a reversal controller which performs a control to reverse a rotational direction of the internal combustion engine in accordance with a reversal instruction; and valve opening and closing operation inhibition means which inhibits an opening and closing operation of the exhaust control valve while the reversal controller is performing the control to reverse the rotational direction of the internal combustion engine.

As described above, when there is provided means for inhibiting an opening and closing operation of the exhaust control valve while the reversal controller is performing the control to reverse the rotational direction of the reversal controller, it is possible to prevent fluctuations in a combustion pressure generated when an ignition operation is performed at an excessively advanced timing during the reversal control. Therefore, it is possible to lower the probability of the failure in reversing the rotational direction of the engine.

It is preferred that the above-described valve opening and closing operation inhibition means be comprised in such a manner as to fix the exhaust control valve in a fully-closed position while the reversal controller is performing the control to reverse the rotational direction of the internal combustion engine, thereby inhibiting the valve opening and closing operation of the exhaust control valve.

A combustion pressure generated when the engine is ignited reaches a maximum when the exhaust control valve is in a fully-closed position. For this reason, when the position of the exhaust control valve is kept in the fully-closed position during the reversal control as described above, the reversal control can be positively performed by increasing the combustion pressure generated during the reversal control.

BRIEF DESCRIPTION OF THE DRAWINGS

The above and other objects and features of the invention will be apparent from the detailed description of the preferred embodiments-of the invention, which are described and illustrated with reference to the accompanying drawings, in which.

DETAILED DESCRIPTION OF THE PREFERRED EMBODIMENTS

Embodiments of the present invention will be described in detail by referring to FIGS. 1 and 2.

Figure 1:
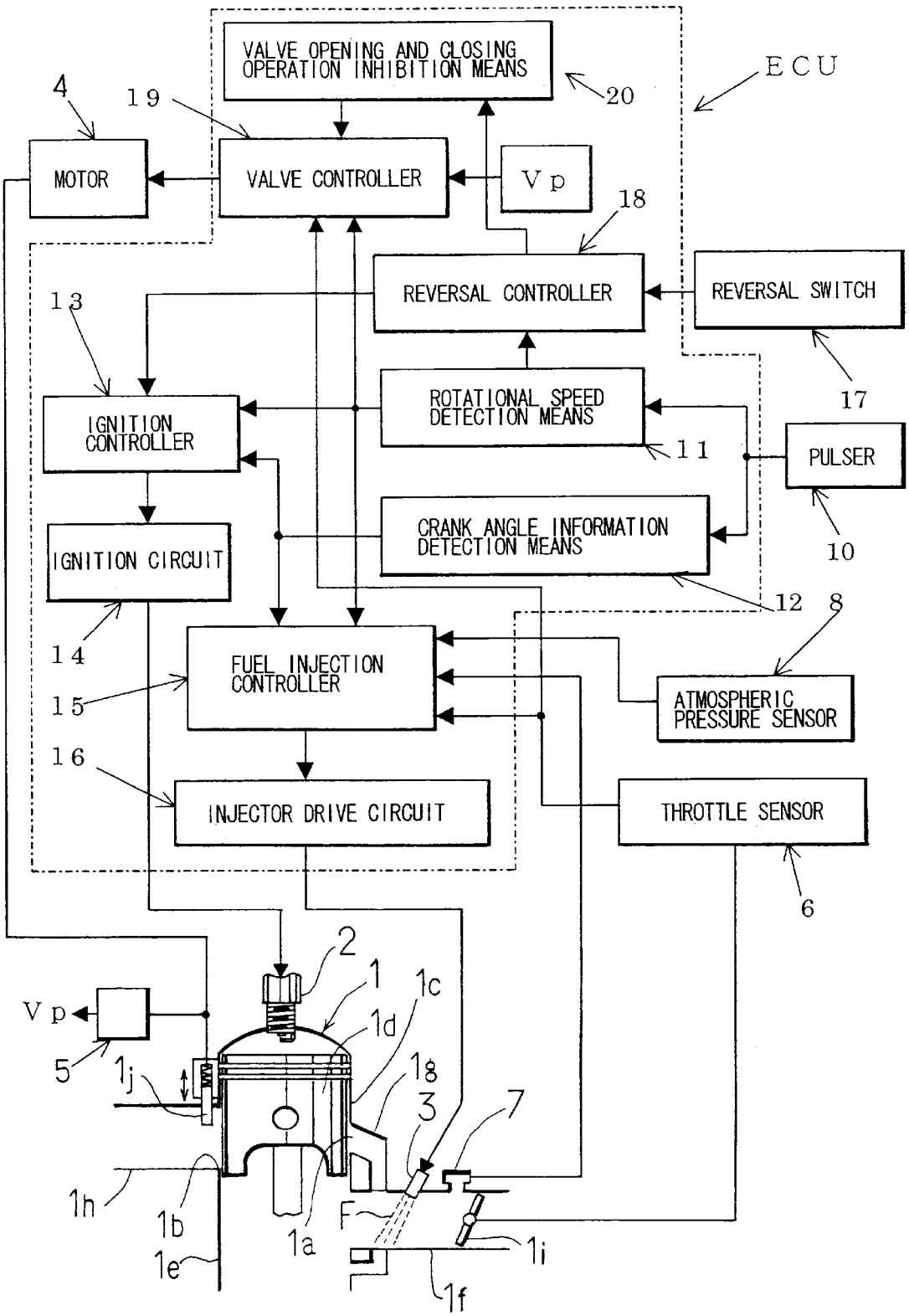
FIG. 1 is a block diagram schematically showing a general construction of an embodiment of the invention.

FIG. 1 shows an example of an embodiment of the invention. In this figure, the reference numeral 1 denotes a two-cycle internal combustion engine. The internal combustion engine 1 comprises a cylinder 1*c* having a scavenge port 1*a* and an exhaust port 1*b*, a piston 1*d* provided in the cylinder 1*c*, an intake pipe 1*f* connected to a crankcase 1*e*, a scavenge passage 1*g* which provides a connection between the crankcase 1*e* and the scavenge port 1*a*, an exhaust pipe 1*h* connected to the exhaust port 1*b*, a throttle valve 1*i* attached to the intake pipe 1*f*, and an exhaust control valve 1*j* provided in such a manner as to open and close an upper part of the exhaust port 1*b*. An ignition plug 2 is attached to an upper part of the cylinder 1*c*, and an injector (an electromagnetic fuel injection valve) 3 is attached to the intake pipe 1*f*.

Incidentally, back flow preventing means such as a reed valve is provided in order to prevent a back flow of an air-fuel mixture through the intake pipe 1*f* when a pressure in the crankcase 1*e* rises while the piston is descending toward a bottom dead center. This back flow preventing means is omitted in the drawing.

Although this is not illustrated, fuel is supplied to the injector 3 from a fuel tank through a fuel pump. The injector 3 opens its valve and injects fuel F into the intake pipe 1*f* when a drive current is given by an injector drive circuit, which will be described later. Because a pressure of the fuel (a fuel pressure) given to the injector 3 is kept at a constant level by means of a pressure regulator, an amount of the fuel injected from the injector 3 (an injection amount) is determined by the time of a fuel injection (an injection time).

The exhaust control valve 1*j* which opens and closes the upper part of the exhaust port 1*b* is provided in order to adjust an exhaust timing. The exhaust timing becomes fast as the exhaust control valve 1*j* is opened, and the exhaust timing becomes slow as the exhaust control valve 1*j* is closed.

When the exhaust timing is delayed by reducing an opening degree of the exhaust control valve 1*j* during a low-speed operation of the engine, an exhaust pulsation effect increases and a charging efficiency increases. When the exhaust timing is advanced by increasing the opening degree of the exhaust control valve 1*j* during a high-speed operation of the engine, the exhaust pulsation effect increases and the charging efficiency increases.

In the example shown in the drawing, the exhaust control valve 1*j* is driven by a motor 4 and displaced between the fully-closed position and the fully-opened position. In order to obtain the opening degree information of the exhaust control valve 1*j*, a valve position sensor 5 is connected to the exhaust control valve 1*j*. This valve position sensor 5 can be formed by a position sensor which detects a position of the exhaust control valve 1*j*. For example, a potentiometer can be used as the position sensor.

A throttle sensor 6 is connected to a drive shaft of the throttle valve 1*i* in order to detect the opening degree of the throttle valve 1*i*. Also, the throttle sensor 6 can be formed by a position sensor which comprises a potentiometer and the like.

To the intake pipe 1*f* of the internal combustion engine, it is attached an intake pressure sensor 7 which detects a pressure within the intake pipe on a downstream side of the throttle valve 1*i*. Furthermore, in this embodiment, an atmospheric pressure sensor 8 which detects an atmospheric pressure is attached to the engine in addition to the intake pressure sensor 7.

The internal combustion engine 1 is also provided with a pulser (a pulse signal generator) 10 which outputs pulse signals containing crank angle information of the engine. For example, the pulser 10 generates a first pulse when a crank angle position (a rotational angle position of the crankshaft) of the engine has coincided with a reference position which is set at a position sufficiently advanced beyond a top dead center (a crank angle position when the piston has reached the top dead center), and this pulser generates a second pulse having a polarity different from that of the first pulse when the crank angle position has coincided with a position corresponding to a start time or an ignition timing at a low speed, which position is set at a position in which the crank angle position has advanced a little beyond the top dead center.

The first pulse generated by the pulser 10 is used as a reference signal which determines the timing of starting a measurement of the ignition timing or a signal for determining the timing of starting the fuel injection. The second pulse generated by the pulser 10 is used as a signal for determining the ignition timing at the low speed of the engine which ignition timing is arithmetically operated by a microprocessor and for which it is impossible to accurately perform a measurement.

In order to control the internal combustion engine, there is provided an electronic control unit (an ECU) equipped with a microprocessor, an ignition device and the like. The ECU shown in the drawing comprises rotational speed detection means 11 which detects a rotational speed of the engine from a pulse generated by the pulser 10, crank angle information detection means 12 which detects crank angle information of the engine from a pulse generated by the pulser, an ignition controller 13, an ignition circuit 14, a fuel injection controller 15, an injector drive circuit 16, a reversal controller 18 which performs a control to reverse a rotational direction of the engine when an instruction for reversal is given by a reversal switch 17 operated by a driver, a valve controller 19 which controls the motor 4 in such a manner as to cause the position of the exhaust control valve 1*j* detected by the valve position sensor 5 to coincide with a desired position determined by various control conditions, and valve opening and closing operation inhibition means 20.

Among these parts, in particular, the rotational speed detection means 11, the crank angle information detection means 12, the ignition controller 13, the fuel injection controller 15, the reversal controller 18, the valve controller 19 and the valve opening and closing operation inhibition means 20 are comprised mainly by a microprocessor provided in the ECU and a predetermined program executed by the microprocessor.

Also, the ignition circuit 14 and injector drive circuit 16 are comprised by a hardware circuit.

Each part will be described in further detail below. The rotational speed detection means 11 is comprised in such a manner as to perform an arithmetical operation of a rotational speed of the engine from generation intervals of pulses (time required for an engine to rotate in a predetermined angle) generated by the pulser 10 using an output of this pulser 10 as an input. The rotational speed information arithmetically operated by the rotational speed detection means 11 is given to the ignition controller 13, the fuel injection controller 15 and the valve controller 19.

Using pulses generated by the pulser 10 as an input, the crank angle information detection means 12 detects that a crank angle position coincides with a reference position and that the crank angle position coincides with a position corresponding to a start time and the ignition timing at a low speed, and gives these pieces of crank angle information to the ignition controller 13 and the fuel injection controller 15.

The ignition controller 13 performs an arithmetical operation of the ignition timing at a rotational speed of the engine detected by the rotational speed detection means 11 by use of an ignition timing arithmetical operation map stored in a ROM of the microprocessor. This ignition timing is arithmetically operated in the form of a time required to rotate the crankshaft from a reference position in which the pulser 10 generates the first pulse to a crank angle position corresponding to the ignition timing. Hereinafter, the above-described time is referred as an ignition timing determination value to be measured.

The ignition controller 13 sets, in an ignition timer, the ignition timing determination value to be measured which is arithmetically operated when it is detected that the pulser 10 has generated the first pulse thereby to cause the measurement of the ignition timing to be started, and gives an ignition signal to the ignition circuit 14 when the ignition timer has finished the measurement of the ignition timing determination value to be measured (when the arithmetically operated ignition timing has been detected).

The ignition circuit 14 which comprises a publicly known circuit, such as a capacitor discharge type circuit, outputs a high voltage for ignition when an ignition signal is given. Because this high voltage is applied to the ignition plug 2, a spark discharge is generated in a discharging gap of the ignition plug 2 to ignite the engine.

The fuel injection controller 15 comprises basic injection amount determining variable arithmetical operation map storage means for storing a basic injection amount determining variable arithmetical operation map which give the relationship between a rotational speed of the engine, an opening degree of the throttle valve and a basic injection amount of fuel. By use of the map stored in this storage means, the fuel injection controller performs an arithmetical operation of basic injection amount determining variable for the rotational speed of the engine detected by the rotational speed detection means 11 and for the opening degree of the throttle valve detected by the throttle sensor 6. Usually, the pressure of the fuel given to the injector 3 is kept at a constant level and the injection amount of fuel is determined by a time of fuel injection from the injector (an injection time) and, therefore, the injection time of fuel is used as an injection amount determining variable. The injection time corresponding to a basic injection amount is regarded as a basic injection time.

By multiplying the basic injection time thus arithmetically operated by a correction coefficient arithmetically operated with respect to the intake pipe pressure detected by the intake pressure sensor 7 and a correction coefficient arithmetically operated with respect to the atmospheric pressure detected by the atmospheric pressure sensor 8, data which gives an actual injection time is arithmetically operated as actual injection time data.

Incidentally, in this embodiment, correction coefficients are arithmetically operated only for the intake pipe pressure and the atmospheric pressure. However, an arithmetical operation of correction coefficients may sometimes be performed for other control conditions such as an intake temperature and a cooling water temperature of the engine.

For example, when the pulser 10 has generated the first pulse in the reference position, the fuel injection controller 15 sets, in an injection timer, the arithmetically operated actual injection time data and gives an injection instruction signal (a rectangular wave signal having a signal width corresponding to an injection time) to the injector drive circuit 16 while this injection timer is performing time-measuring of an actual injection time. While the injection instruction signal is being given, the injector drive circuit 16 gives a drive current to the injector 3 and causes a fuel to be injected from this injector.

The valve controller 19 performs an arithmetical operation of the desired position of the exhaust control valve 1*j* with respect to control conditions, such as a rotational speed of the engine and the opening degree of the throttle valve, and controls the motor 4 so that a present position of the valve detected by a position detection signal Vp outputted by the valve position sensor 5 is caused to coincide with the desired position.

In order to remove carbon and tar adhering to the exhaust control valve, the valve controller 19 controls the exhaust control valve in order to performing a cleaning operation which forcedly moves the exhaust control valve from a fully-closed position to a fully-opened position and thereafter forcedly returns the exhaust control valve from the fully-opened position to the fully-closed position.

Figure 4:
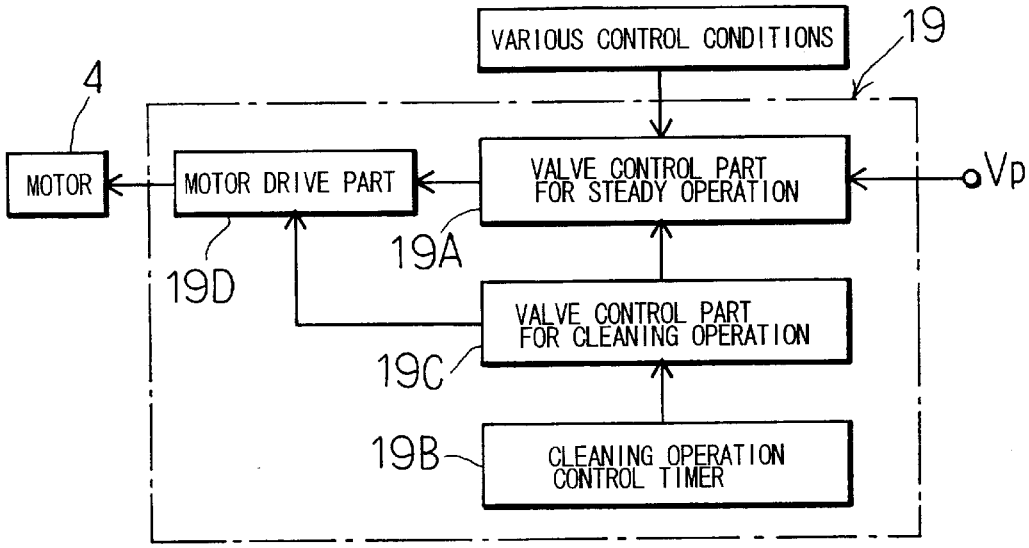
FIG. 4 is a block diagram showing an example of a construction of a valve controller in a case where a cleaning operation of an exhaust control valve is controlled by a timer.

FIG. 4 shows an example of a construction of the valve controller which performs the control of the exhaust control valve for various control conditions and the control of the exhaust control valve during the cleaning operation as described above. In FIG. 4, the reference numeral 19A denotes a valve control part for steady operation, which generates a valve drive instruction to give an instruction for moving the exhaust control valve to a predetermined position for various control conditions, such as the rotational speed of the engine and the opening degree of the throttle valve, 19B denotes a cleaning operation control timer, which is provided in the ECU and repeats a time-measuring operation to measure a fixed time Ta during the operation of the engine, and 19C denotes a valve control part for cleaning operation, which generates a valve drive instruction each time the timer 19B measures the fixed time. The valve drive instruction outputted from the valve control part for steady operation 19A and the valve drive instruction outputted from the valve control part for cleaning operation 19C are given to a motor drive part 19D, and a drive current is given from the motor drive part 19D to the motor 4 which manipulates the exhaust control value.

When the valve controller is comprised as shown in FIG. 4, the valve control part for steady operation 19A performs an arithmetical operation of the desired position of the exhaust control valve 1*j* for various control conditions, such as the rotational speed of the engine and the opening degree of the throttle valve, and generates the value drive instruction so that the present valve position detected by the position detection signal Vp outputted by the valve position sensor 4 is caused to coincide with the desired position. The motor drive part 19D gives the drive current to the motor 4 in accordance with the valve drive instruction so that the position of the exhaust control value is caused to coincide with the desired position.

When the timer 19B measures a fixed time, the valve control part for cleaning operation 19C stops the control of the exhaust control valve which is performed by the valve control part for steady operation 19A, and at the same time, generates a valve drive instruction to cause the exhaust control valve 1*j* to perform a cleaning operation. The valve drive instruction generated by the valve control portion for cleaning operation 19C is an instruction to move the exhaust control valve in such a manner that the exhaust control valve is forcedly displaced from the fully-closed position to the fully-opened position and thereafter this exhaust control valve is forcedly returned from the fully-opened position to the fully-closed position. The motor drive part causes the exhaust control valve to perform the cleaning operation by giving the drive current to the motor 4 in accordance with the valve drive instruction.

Figure 6A:
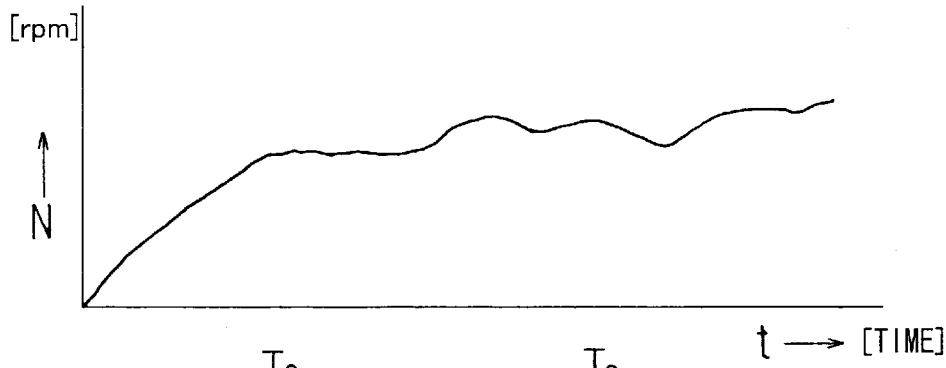
FIG. 6A is a graph showing an example of a change in the rotational speed of the engine with respect of time.
Figure 6B:
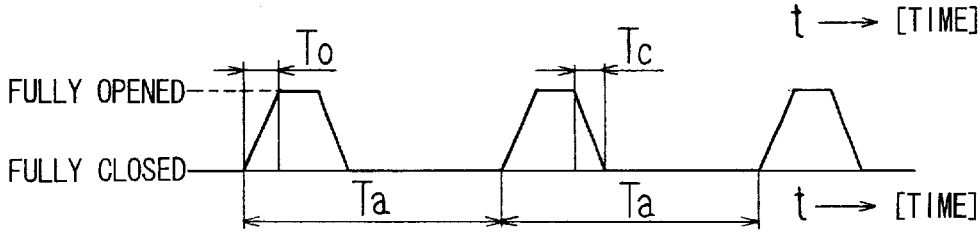
FIG. 6B is a time chart showing an operation of an exhaust control valve in a case where a cleaning operation of the exhaust control valve is performed by a control conducted by a timer while the rotational speed is changing as shown in FIG. 6A.

FIGS. 6A and 6B are time charts for illustrating the cleaning operation of the exhaust control valve when the operation is controlled by a timer. FIG. 6A shows a change in a rotational speed N of the engine with respect to time t. FIG. 6B shows an operation of the exhaust control valve. In a case where the cleaning operation of the exhaust control valve is controlled by the timer, regardless of the change in the rotational speed N of the engine with respect of time t as shown in FIG. 6A, each time the cleaning operation control timer 19B measures a fixed time Ta, as shown in FIG. 6B, the exhaust control valve 1*j* is forcedly moved to the fully-opened position and after that, it is forcedly moved to the fully-closed position. Carbon, tar and the like adhering to the exhaust control valve are removed by this cleaning operation.

Figure 5:
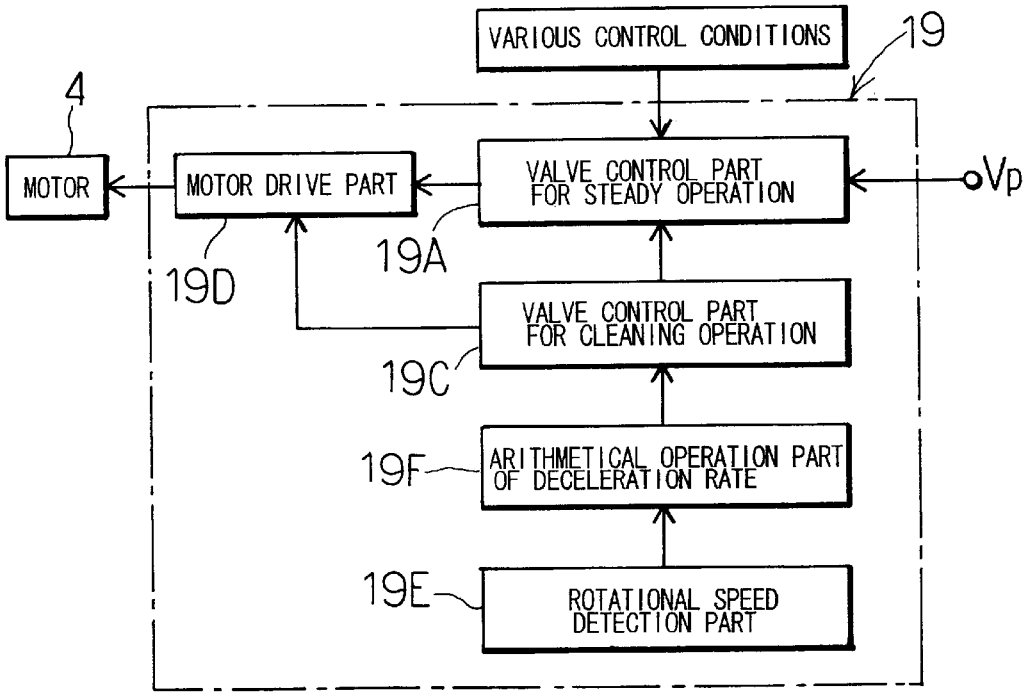
FIG. 5 is a block diagram showing an example of a construction of a valve controller in a case where a cleaning operation is performed when a deceleration rate of a rotational speed of the engine exceeds a set value.

Furthermore, there is also a case where the cleaning operation of the exhaust control valve is performed when a rate of change with time in the rotational speed of the engine during a deceleration (a deceleration rate) has exceeded a set value. FIG. 5 shows an example of a construction of the valve controller 19 in such a case where the cleaning operation of the exhaust control valve is performed when the deceleration rate of the engine has exceeded the set value.

In FIG. 5, the reference numeral 19E denotes a rotational speed detection part which detects the rotational speed of the engine, and 19F denotes an arithmetical operation part of deceleration rate, which performs an arithmetical operation of the deceleration rate of the rotational speed detected by the rotational speed detection part 19E. Furthermore, the reference numeral 19A denotes a valve control part for steady operation like that shown in FIG. 4, and the reference numeral 19C denotes a valve control part for cleaning operation, which generates the valve drive instruction to cause the cleaning operation to be performed when the deceleration rate which is arithmetically operated by the arithmetical operation part of deceleration rate 19F has exceeded the set value.

Figure 6C:
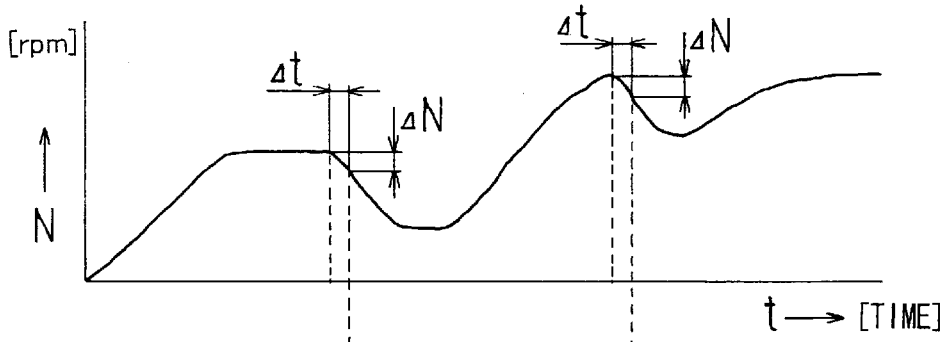
FIG. 6C is a graph showing a change in the rotational speed of the engine with respect to time.
Figure 6D:
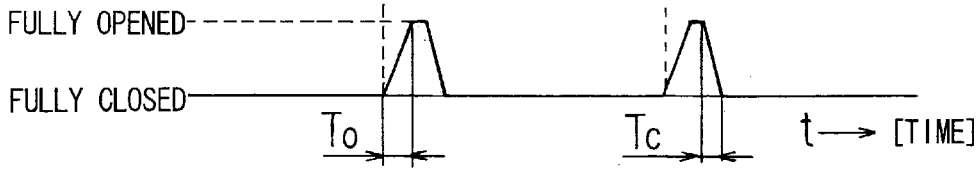
FIG. 6D is a time chart showing an operation of the exhaust control valve in a case where the cleaning operation of the exhaust control valve is performed when a time change ratio of the rotational speed shown in FIG. 4C exceeds a set value.

When the valve controller is comprised as shown in FIG. 5, as shown in FIG. 6C, the rate of change with time in the rotational speed N of the engine during a decrease in the rotational speed N (a deceleration rate), $\Delta N/\Delta t$, is arithmetically operated by the arithmetical operation part of deceleration rate 19F. When the extent of this deceleration rate has exceeded the set value, the valve control part for cleaning operation 19C generates a valve drive instruction which requires that the exhaust control valve is forcedly moved from the fully-closed position to the fully-opened position and that thereafter this exhaust control valve is forcedly returned from the fully-opened position to the fully-closed position. Because the motor drive part 19D supplies the drive current to the motor 4 in accordance with the valve drive instruction, as shown in FIG. 6D, the exhaust control valve is forcedly moved from the fully-closed position to the fully-opened position and then forcedly returned to the fully-closed position.

When an instruction for reversal that the rotational direction of the engine should be reversed is given by the reversal switch 17 operated by a driver, the reversal controller 18 performs a deceleration step, which lowers the rotational speed of the engine to a set rotational speed lower than an idling speed by methods such as a stop of fuel injection, a stop of an ignition operation (a misfire of the engine) and a delay of ignition timing, a reversal step of rotational direction, which ignites the engine at an excessively advanced ignition timing when the rotational speed of the engine has lowered to the set rotational speed thereby to push back the piston which has been displaced toward the top dead center, and a step of ascertaining the reversal operation to ascertain whether the rotational direction of the engine has reversed. After it is ascertained in the step of ascertaining the reversal operation that the rotational direction has reversed, the reversal controller 18 causes the operation of the engine to be performed in the reversed rotational direction by performing the ignition operation at the timing suitable for keeping the rotation of the engine in the reversed rotational direction.

In order to ensure that a stable combustion pressure is generated when the ignition operation is performed at the excessively advanced timing in the process of reversing the rotational speed, there is provided the valve opening and closing operation inhibition means 20 in the present invention. The valve opening and closing operation inhibition means performs a process of inhibiting an operation of the exhaust control valve while the reversal controller 18 is performing the reversal control to reverse the rotational speed of the engine.

In this embodiment, immediately after the reversal controller has decided to start the reversal control after receiving an instruction for reversal (before the reversal controller starts the deceleration step), the reversal controller gives an instruction for closing the valve to the valve controller 19 and causes the exhaust control valve 1*j* to be displaced to the fully-closed position. As a result, the position of the exhaust control valve is fixed in the fully-closed position and the opening and closing operation of the exhaust control valve is inhibited until the reversal control is finished. In order to fix the exhaust control valve in the fully-closed position, for example, it is necessary that the desired position of the exhaust control valve coincides with the fully-closed position regardless of the control conditions used in controlling the exhaust control valve.

Figure 3:
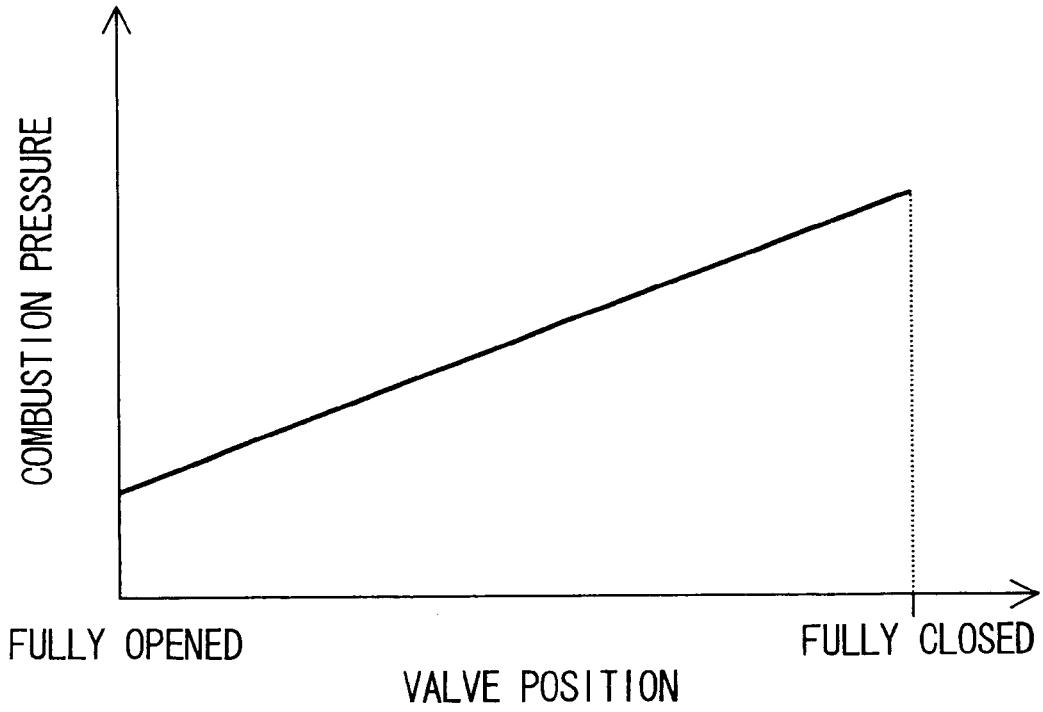
FIG. 3 is a diagram showing relationship between a position of an exhaust control valve and a combustion pressure in a two-cycle internal combustion engine provided with the exhaust control valve which adjusts an exhaust timing.

In the two-cycle internal combustion engine provided with the exhaust control valve, as shown in FIG. 3, the combustion pressure reaches a maximum when the exhaust control valve is in the fully-closed position. Therefore, as described above, when the position of the exhaust control valve is fixed in the fully-closed position during the reversal control, it is possible to generate a high combustion pressure when the ignition operation is performed at the excessively advanced timing during the reversal control, thereby the rotational direction of the engine can be positively reversed.

Figure 2:
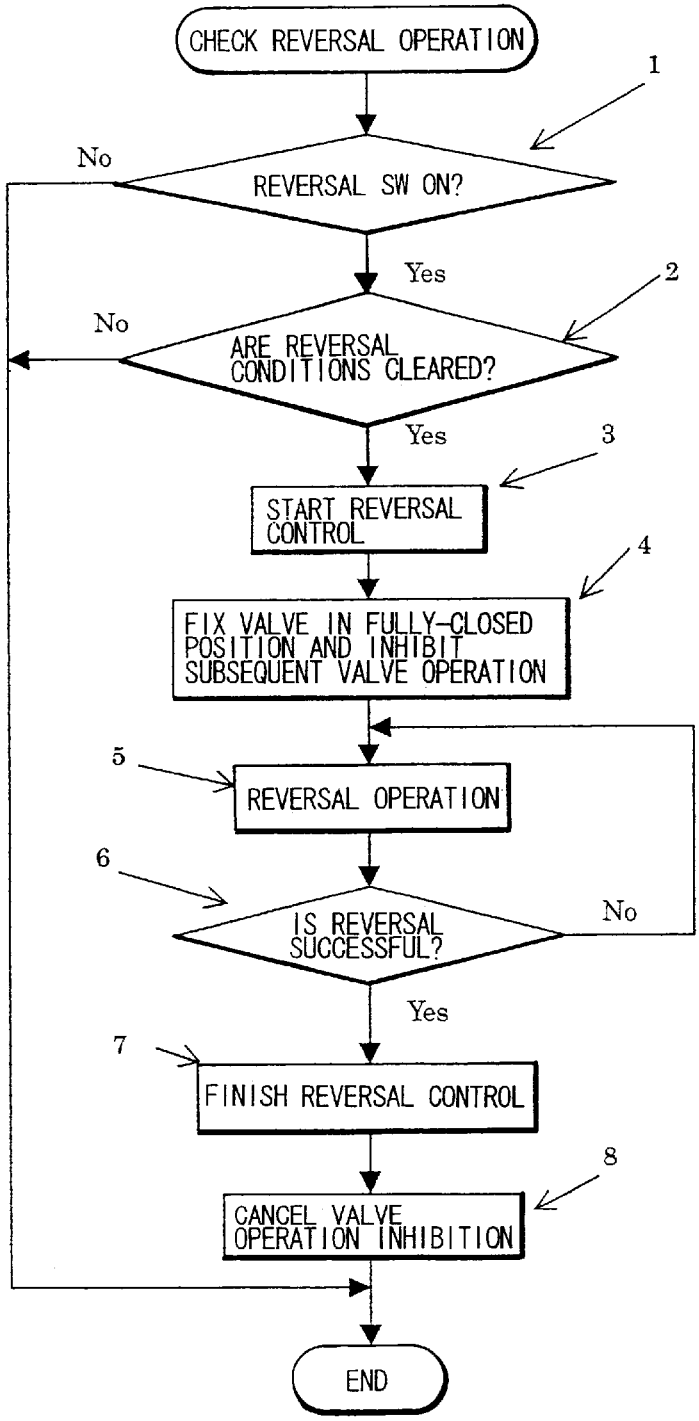
FIG. 2 is a flow chart showing an example of an algorithm of a reversal-operation check routine of a program executed by a microprocessor of an electronic control unit in the controllers shown in FIG. 1.

In FIG. 2, it is shown an example of a flow chart showing an algorithm of a reversal-operation check routine of a program executed by a microprocessor provided in the ECU during the reversal control in the controllers shown in FIG. 1. In the example shown in FIG. 2, the reversal switch comprises a momentary switch such as a push-button switch, and when the rotational direction of the engine is reversed, the reversal switch is kept in an on condition for a short time.

The routine shown in FIG. 2 is executed each time the timer in the microprocessor measures the fixed time. When the reversal-operation check routine shown in FIG. 2 is started, first in Step 1, whether the reversal witch has been closed is judged. When, as a result of this judgment, it is judged that the reversal switch has not been closed, this routine is finished without doing anything (without performing the reversal control).

When it is judged in Step 1 that the reversal switch has been brought into an on condition, the processing proceeds to Step 2 and whether conditions required for starting the reversal operation (reversal condition) are met is judged. The conditions for starting the: reversal operation are conditions which hold for safety. These conditions include, for example, that the rotational speed of the engine should be not more than a set value, that a brake has been applied, and that an accelerator grip has been returned to a position in which the opening degree of the throttle valve corresponds to the fully-closed position.

When, in Step 2, it is judged that the reversal conditions are not met, this routine is finished without executing other steps.

When, in Step 2, it is judged that the reversal conditions are met, the processing proceeds to Step 3 and the reversal control is started. First in Step 4, the exhaust control valve is fixed in the fully-closed position and processing for inhibiting a subsequent operation of the exhaust control valve is executed. The valve opening and closing operation inhibition means 20 is constituted by this Step 4.

After the inhibition of the operation of the exhaust control valve, the reversal operation is started in Step 5. In the reversal operation, first the deceleration step is performed which lowers the rotational speed of the engine to a set rotational speed lower than the idling speed by methods such as a stop of the fuel injection, a stop of the ignition operation (a misfire of the engine) and a delay of the ignition timing. When it has been ascertained that the rotational speed of the engine has been lowered to the set rotational speed by this deceleration process, the ignition signal is given to the ignition circuit at the excessively advanced timing so that the ignition operation is performed. After that, when it is ascertained in Step 6 that the rotational direction of the engine has been reversed, the processing proceeds to Step 7, in which the reversal control is finished by starting the ignition operation at a timing suitable for rotating the engine in the reversed rotational direction. After that, in Step 8, the inhibition of the operation of the exhaust control valve is cancelled thereby to finish the reversal-operation check routine.

Incidentally, in the above-described embodiment, the exhaust control valve is fixed in the fully-closed position while the reversal control is being performed. The present invention, however, is not limited to the case where the exhaust control valve is fixed exactly in the fully-closed position during the reversal control, and the opening and closing operation of the exhaust control valve may be inhibited with the exhaust control valve fixed in positions other than the fully-closed position (preferably, in a position close to the fully-closed position). When the opening and closing operation of the exhaust control valve is inhibited during the reversal control, it is possible to generate the stable combustion pressure when the ignition operation is performed at the excessively advanced timing; therefore, the probability of failure in the reversing of the rotational direction can be lowered.

As described above, according to the present invention, there is provided means for inhibiting the opening and closing operation of the exhaust control valve while the reversal controller is, performing the control to reverse the rotational direction, fluctuations in the combustion pressure which occur when the ignition operation is performed during the reversal control at the excessively advanced timing are prevented, whereby it is possible to lower the probability of failure in the reversing of the rotational direction of the engine and hence to raise the probability of a success in the reversal control.

Particularly, in the present invention, when the valve operation inhibiting means is comprised in such a manner that the opening and closing operation of the exhaust control valve is inhibited by fixing the position of the valve in the fully-closed position while the reversal controller is performing the control to reverse the rotational direction of the internal combustion engine, it is possible to increase a combustion pressure which is generated when the engine is ignited at the excessively advanced timing and, therefore, it is ensured that the reversal control is positively performed.

Although some preferred embodiments of the invention have been described and illustrated with reference to the accompanying drawings, it will be understood by those skilled in the art that they are by way of examples, and that various changes and modifications may be made without departing from the spirit and scope of the invention, which is defined only to the appended claims.

What is claimed is:

1. An electronic control unit for a two-cycle internal combustion engine, comprising:

a valve controller which controls a position of an exhaust control valve provided in such a manner as to open and close an upper part of an exhaust port of said internal combustion engine to adjust exhaust timing of the two-cycle internal combustion engine;

a reversal controller which performs control to reverse a rotational direction of said internal combustion engine in accordance with a reversal instruction; and valve opening and closing operation inhibition means which inhibits an opening and closing operation of said exhaust control valve while said reversal controller is performing the control to reverse the rotational direction of said internal combustion engine.

2. The electronic control unit for a two-cycle internal combustion engine according to claim 1, wherein said valve opening and closing operation inhibition means is comprised in such a manner as to fix said exhaust control valve in a fully-closed position when the valve opening and closing operation inhibition means inhibits the opening and closing operation of said exhaust control valve.

3. The electronic control unit for a two-cycle internal combustion engine according to claim 1, wherein the electronic control unit further comprises a cleaning operation control timer which repeats a time-measuring operation for measuring a fixed time during the operation of said internal combustion engine and control means of exhaust control valve for cleaning operation which controls said exhaust control valve, each time said timer measures a fixed time, in order to ensure that the cleaning operation is performed which forcedly moves said exhaust control valve from said fully-closed position to a fully-opened position and thereafter forcedly returns the exhaust control valve to the fully-opened position.

4. The electronic control unit for a two-cycle internal combustion engine according to claim 2, wherein said valve controller comprises a cleaning operation control timer which repeats a time-measuring operation for measuring a fixed time during the operation of said internal combustion engine and a control part of exhaust control valve for cleaning operation which controls said exhaust control valve, each time said timer measures a fixed time, in order to ensure that the cleaning operation is performed which forcedly moves said exhaust control valve from said fully-closed position to the fully-opened position and thereafter forcedly returns the exhaust control valve to the fully-opened position.

5. The electronic control unit for a two-cycle internal combustion engine according to claim 1, wherein said valve controller comprises a rotational speed detection part which detects a rotational speed of said internal combustion and exhaust valve control means for cleaning operation which controls said exhaust control valve, when a rate of change with time in the rotational speed detection part detected by said rotational speed during a decrease in the rotational speed has exceeded a set value, in order to ensure that a cleaning operation is performed which forcedly moves said exhaust control valve from said fully-closed position to the fully-opened position and thereafter forcedly returns the exhaust control valve to the fully-opened position.

6. The electronic control unit for a two-cycle internal combustion engine according to claim 2, wherein said valve controller comprises a rotational speed detection part which detects a rotational speed of said internal combustion and an exhaust valve control part for cleaning operation which controls said exhaust control valve, when a rate of change with time in the rotational speed detected by said rotational speed detection part during a decrease in the rotational speed has exceeded a set value, in order to ensure that a cleaning operation is performed which forcedly moves said exhaust control valve from said fully-closed position to the fully-opened position and thereafter forcedly returns the exhaust control valve to the fully-opened position.

* * * * *